United States Patent [19]

Adachi et al.

[11] Patent Number: 4,478,680

[45] Date of Patent: Oct. 23, 1984

[54] METHOD FOR TREATING ELECTROLYTIC DIAPHRAGM

[75] Inventors: Takeshi Adachi, Yokosuka; Tetsuo Takeshita, Tokyo; Itsuaki Matsuda, Yokohama, all of Japan

[73] Assignee: Showa Denko K.K., Tokyo, Japan

[21] Appl. No.: 471,459

[22] Filed: Mar. 2, 1983

[30] Foreign Application Priority Data

Sep. 5, 1978 [JP] Japan ..... 53-108056

Related U.S. Application Data

[63] Continuation of Ser. No. 240,366, Mar. 4, 1981, abandoned.

[51] Int. Cl.[3] ..... C25B 13/00

[52] U.S. Cl. ..... 162/103; 162/106; 162/155; 204/295

[58] Field of Search ..... 162/105, 106, 155, 103, 162/169, 181.7; 204/295

[56] References Cited

U.S. PATENT DOCUMENTS

| | | | |
|---|---|---|---|
| 3,694,281 | 9/1972 | Le Duc | 162/155 |
| 3,932,208 | 1/1976 | Strain | 162/106 |
| 3,939,055 | 2/1976 | Foster | 162/105 |

*Primary Examiner*—Peter Chin

*Attorney, Agent, or Firm*—Wenderoth, Lind & Ponack

[57] ABSTRACT

A method for treating an electrolytic diaphragm formed by adhering asbestos fibers to the surface of an electrolytic cathode made of a wire mesh or porous plate, which comprises permeating water glass into the diaphragm, then permeating a chloroprene latex into the water glass-treated diaphragm, and drying the treated diaphragm under heat.

4 Claims, No Drawings

METHOD FOR TREATING ELECTROLYTIC DIAPHRAGM

This application is a continuation of Ser. No. 240,366 filed Mar. 4, 1981, now abandoned.

This invention relates to a method for treating an electrolytic diaphragm, particularly an asbestos diaphragm used in electrolyzing an aqueous solution of sodium chloride.

Diaphragms made of asbestos are widely used in the electrolysis of aqueous solutions, particularly an aqueous solution of sodium chloride. Such asbestos diaphragms have various defects in spite of their many advantages. For example, they have low strength in a wet condition, and particularly in the early stage of electrolysis, they get greatly swollen and decrease in strength. Accordingly, they may be damaged by the liquid flow at the time of gas evolution, and in an extreme case, holes may occur. Furthermore, when asbestos is set at the cathode and used in electrolysis, it is loose in the early stage, and its water flux is high. Accordingly, a long period of time is required until the concentration of sodium hydroxide formed reaches a proper value.

In an attempt to remove these defects, starch or chloroprene rubber is used as a binder for asbestos paper. However, the strength of the asbestos diaphragm using such a binder is still insufficient in the production of sodium hydroxide, and it is frequently broken at a high current density.

As another measure for removing the aforesaid defects, it was suggested to use an organic polymer, particularly a fluorine-containing resin, as a binder or clogging agent (see, for example, Japanese Patent Publication No. 32515/73). When such a fluorine-containing resin is to be used as a binder, it should be treated at a high temperature of 260° to 320° C. or even higher. This inevitably embrittles the asbestos fibers. Furthermore, the asbestos diaphragms reinforced with a fluorine-containing resin, in the early stage of electrolysis, sometimes have a water flux about 10 times as high as that in a stable condition. This great variation in water flux with time makes it difficult to adjust the concentration of sodium hydroxide formed. Furthermore, the diaphragm reinforced with the fluorine-containing resin has a reduced current efficiency, and since the resin is hydrophobic, it must be treated to render it hydrophilic.

A method was also proposed which comprises treating a diaphragm made of asbestos, synthetic fibers, etc. with an aqueous solution of an alkali silicate and an auxiliary agent (Japanese Patent Publication No. 23800/77). When such a diaphragm is used, the voltage of the electrolysis cell cannot be reduced as expected, and no satisfactory result is obtained.

The above-mentioned prior method for treating a diaphragm with chloroprene rubber will now be described in more detail. A chloroprene latex is used in this treatment, but the problem of the treatment with chloroprene latex is that the latex cannot fully permeate into the inside of the diaphragm, and a chloroprene rubber film is prone to form to an extent more than necessary on the surface of the diaphragm. When the amount of the chloroprene latex on the surface of the diaphragm is too large, it forms a film which is impervious to gases, and swelling of the diaphragm by gas occurs at the time of electrolysis. If the strength of the diaphragm is low, it will immediately be broken, and even when it is not broken, the voltage rises owing to gases. Furthermore, when the amount of the chloroprene latex in the inside of the diaphragm is small, the reinforcing effect is localized at the surface portion, and the diaphragm has a two-layer structure. As a result, the diaphragm will be broken by swelling due to the gas from a gas reservoir.

It is necessary therefore to permeate the chloroprene latex fully and uniformly into the inside of the layer of the diaphragm. If an electrolyte such as NaOH or NaCl is present on the surface of the asbestos fibers, a latex generally tends to be coagulated by it. The chloroprene latex also has this tendency, and its permeation into the diaphragm is markedly hampered. Asbestos has the ability to adsorb anionic latex particles such as chloroprene latex, which is a favorable property. However, this property varies from asbestos to asbestos, and some asbestos has a very strong adsorptive power. If the adsorptive power of asbestos is too strong, the permeation of the latex into the diaphragm is hampered, and many chloroprene latex particles are adsorbed to the surface of the diaphragm to impair its performance.

It is an object of this invention to provide a novel treating method for the production of an asbestos diaphragm free from such defects.

Another object of this invention is to provide a method for obtaining an asbestos diaphragm free from the above defects which comprises applying a chloroprene latex, known as a binder for asbestos diaphragms, to asbestos under special conditions.

The method for treating an electrolytic diaphragm to be treated in accordance with this invention is prepared by adhering asbestos fibers to the surface of an electrolytic cathode made of a wire mesh or porous plate to form a diaphragm. In accordance with the invention, this diaphragm is treated by a method which comprises permeating water glass into the diaphragm, then permeating a chloroprene latex into the water glass-treated diaphragm, and drying the treated cathode under heat.

In a wet condition, the asbestos diaphragm obtained by the method of this invention has an improved strength, undergoes little swelling and is dimensionally stable. Its water flux varies little with time, and its electrical resistance is low. When this asbestos diaphragm is used as a diaphragm for electrolysis, the current efficiency becomes stable, and the liquid level at the anode and the cathode can be maintained stable. Furthermore, the asbestos diaphragm in accordance with this invention has a long service life, and the frequency of replacing the asbestos diaphragm can be reduced. In addition, since the method of this invention does not require high temperature treatment as in the case of the treatment with a fluorine-containing resin, damage to the asbestos owing to the high temperature treatment can be prevented.

In adhering asbestos fibers to the surface of a cathode made of a wire mesh or porous plate in this invention, a known method can be used. For example, there is conveniently used a method, known as a deposit method, which comprises contacting an aqueous slurry of well spread asbestos fibers with the surface of the porous cathode and depositing the asbestos fibers on the surface of the cathode by suction under reduced pressure. The amount (thickness) of the asbestos deposited is preferably in the range of 1.5 mm to 2.5 mm.

Water glass, as used in this invention, denotes a water-soluble alkali silicate or a mixture of it with silicic acid. Sodium silicate is a typical example, and the $SiO_2/Na_2O$ mole ratio is preferably from 2 to 4.

To permeate water glass into the diaphragm obtained by deposition of asbestos, the diaphragm is dipped in an aqueous solution of water glass, and suction under reduced pressure is employed to permeate the aqueous solution of water glass into the diaphragm. By this method, the water glass adheres uniformly not only to the surface of the asbestos, but also to the entire asbestos layer. The suitable concentration of the aqueous solution of water glass is from 0.05 to 10 g/liter, preferably 1 to 5 g/liter. The amount of the water glass solution to be permeated by suction under reduced pressure is preferably in the range of 0.5 liters to 2 liters/$dm^2$.

Permeation of the chloroprene latex into the thus treated diaphragm may be conveniently performed by dipping the diaphragm in the chloroprene latex and applying suction to the diaphragm under reduced pressure. Thus, after the diaphragm is withdrawn from the aqueous solution of water glass, and the excess water glass is removed by suction until droplets of water glass do not fall off from the diaphragm, the diaphragm is dipped in the chloroprene latex. The concentration of the chloroprene latex is in the range of 0.01 to 4% by weight, preferably from 0.05 to 0.7% by weight. Preferably, the degree of pressure reduction is adjusted to −300 to −600 mmHg. The pick-up of the chloroprene latex is adjusted to 2 to 50% by weight, preferably 4 to 20% by weight, as the solid chloroprene content, based on the asbestos.

The diaphragm treated with the chloroprene latex is left to stand for 30 to 60 minutes preferably under a reduced pressure of −350 to −400 mmHg, and thereafter dried by heating it at 50° to 150° C., preferably 70° to 140° C. Thus, the treating method of this invention is completed. Although the treating method in accordance with this invention has been described with reference to its preferred embodiment, it should be understood that the invention is in no way limited to such a specific embodiment, and suitable embodiments of the method may be employed within the scope of the invention as defined in the appended claims. For example, instead of dipping, a coating or spraying method may be used to permeate the aqueous solution of water glass or chloroprene latex into the diaphragm.

In accordance with the method of this invention, the chloroprene latex can be well permeated into the entire layer of the diaphragm by first permeating an aqueous solution of water glass into the asbestos diaphragm. Although no clear reason for this has been elucidated, it is presumed that water glass has an effect of inhibiting the adsorptive power of asbestos.

The following examples illustrate the method of this invention more specifically.

EXAMPLE 1

Three grams of water glass ($SiO_2$ 28–30%; $Na_2O$ 9–10%; liquid sodium silicate No. 3, a product of Kanto Kagaku K.K.) was diluted with 1 liter of water, and then 25 g of spread asbestos fibers were added. The mixture was stirred for 5 minutes, allowed to stand, and filtered. The water glass-treated asbestos fibers were dipped in a solution obtained by diluting 2 ml of a chloroprene latex (34.5% by weight) (Neoprene Latex #736, a tradename for a produce of Showa Neoprene Co., Ltd.; to be abbreviated NL hereinbelow) with 1 liter of water. After thorough stirring, the slurry was allowed to stand for 30 minutes to deposit the fibers. It was ascertained by external observation that the turbidity of the supernatant liquid scarcely changed before and after the addition of the asbestos fibers.

COMPARATIVE EXAMPLE 1

The same treatment as in Example 1 was carried out except that the treatment with water glass was omitted. It was ascertained by external observation that the supernatant liquid resulting after deposition of the fibers was almost clear.

It is seen from the result that water glass well reduces the surface activity of the asbestos fibers.

EXAMPLE 2

Asbestos fibers were deposited on a wire mesh to a thickness of about 1.9 mm from an aqueous dispersion of the asbestos fibers to prepare a diaphragm. From one surface of the diaphragm, a 2 g/liter aqueous solution of water glass (the same as in Example 1) was permeated in an amount of 1 liter/$dm^2$. Separately, 2 ml of an NL#736 (neoprene latex) (34.5% by weight) was diuted with 1 liter of water, and the dilution was permeated through the diaphragm. The time required for permeation was 20 minutes. In treating with the latex, the opposite surface of the diaphragm was maintained at −450 mmHg.

The pick-up of chloroprene was 4.5% by weight as solids based on the asbestos fibers.

After the treatment with the chloroprene latex, the diaphragm was cut and its inside was observed. It was found that the latex was well distributed in the entire cross sectional surface of the diaphragm.

COMPARATIVE EXAMPLE 2

The same treatment as in Example 2 was performed except that the diaphragm was treated with water in place of water glass. It took 74 minutes to pass 1 liter of the NL through the diaphragm, and the NL particles did not fully permeate into the inside of the diaphragm but were localized on the surface layer.

EXAMPLE 3

Preparation of a cathode (1) Asbestos was deposited on a wire mesh to a thickness of 1.9 mm.

(2) Water glass (1 g/liter) was permeated into the resulting diaphragm in an amount of 1 liter/$dm^2$.

(3) 5 ml of NL#400 (gel polymer) (50% by weight) was diluted with 1 liter of water, and the resulting diluted latex was permeated into the diaphragm in an amount of 1 liter/$dm^2$.

(4) The treated diaphragm was dried at 120° C. for 14 hours.

Electrolysis

An aqueous solution of sodium chloride (310 g/liter) was electrolyzed using the resulting diaphragm as a cathode under the following conditions.

Level of the anolyte solution: 50 cm
Cell temperature: 70° C.
Anode: Ti coated with $RuO_2$ (1 $dm^2$)
Interelectrode distance: 7 mm
Current: 20 A/$dm^2$
Electrolysis period: 3 weeks
The results are shown in Table 1.

EXAMPLE 4

Example 3 was repeated except that in the procedure (3), 2 ml of NL#736 (34.5% by weight) was used instead of the NL #400. The results are shown in Table 1.

EXAMPLE 5

Example 3 was repeated except that an aqueous solution of water glass (5 g/liter) was used instead of the water glass (1 g/liter). The results are shown in Table 1.

EXAMPLE 6

Example 3 was repeated except that instead of the procedure (3), 10 ml of NL#736 was diluted with 1 liter of water, and the diluted latex was permeated into the diaphragm in an amount of 800 ml/dm$^2$. The results are shown in Table 1.

EXAMPLE 7

Example 3 was repeated except that instead of the procedure (3), 20 ml of NL#736 was diluted with 1 liter of water, and the diluted latex was permeated into the diaphragm in an amount of 580 ml/dm$^2$. The results are shown in Table 1.

TABLE 1

| | Example | | | | |
|---|---|---|---|---|---|
| | 3 | 4 | 5 | 6 | 7 |
| Voltage | 3.03 | 3.07 | 3.07 | 3.01 | 3.00 |
| NaOH concentration (g/liter) | 120 | 120 | 120 | 120 | 100 |
| Purity of $Cl_2$ (%) | 98.5 | 98.5 | 98.5 | 98.6 | 98.7 |
| $H_2$ concentration in $Cl_2$ (%) | 0.07 | 0.07 | 0.07 | 0.07 | 0.07 |

COMPARATIVE EXAMPLE 3

Example 3 was repeated except that the treatment with water glass, the treatment with NL and the drying treatment were not performed. The results of electrolysis were as follows:

Voltage: 3.20 V
NaOH concentration: 80 g/liter
$Cl_2$ purity: 97.8%
$H_2$ concentration in $Cl_2$: 0.13%

COMPARATIVE EXAMPLE 4

The water treatment described in Comparative Example 2 was performed instead of the water glass treatment. Otherwise, the same treatment and the same electrolysis as in Examples 3, 4 and 5 were respectively performed. The electrolysis voltage measured two weeks later was about 0.2 V higher than in the case of performing the water glass treatment, and swelling due to gases frequently occurred in the diaphragm. It was thus found that the reinforcing effect of the diaphragm was low, and the voltage was increased.

While the amount of the electrolyte solution withdrawn was less than 20 ml/min. in Examples 3 to 5, it was about 45 ml/min. in Comparative Example 3. This shows that the effect of decreasing the amount of the electrolyte solution withdrawn was increased by the water glass and NL treatments. Two weeks after the initiation of the electrolysis, the diaphragms did not become swollen in Examples 3 to 5, but the diaphragm obtained in Comparative Example 3 swelled to about two times in thickness. The tensile strengths of the diaphragms in Examples 3 to 5 were 1.1 kg/cm$^3$, and the diaphragm in Comparative Example 3 had a tensile strength of 0.2 kg/cm$^2$, both two weeks after the initiation of the electrolysis. It is therefore seen that the water glass and NL treatments increased the dimensional stability and physical strength of the diaphragms.

What is claimed is:

1. A method for treating an electrolytic diaphragm, said diaphragm including a layer of asbestos fibers adhered to the surface of an electrolytic cathode made of a wire mesh or porous plate, said method comprising permeating water glass into substantially the entire thickness of said layer of fibers of the diaphragm, by dipping the diaphragm in an aqueous solution of the water glass, permeating a chloroprene latex into substantially the entire thickness of the thus treated layer of fibers in a wet state of the layer of fibers, by dipping the diaphragm in the chloroprene latex without any intervening treatment of the fibers, and drying the thus treated diaphragm under heat, wherein the concentration of the water glass in the aqueous solution is 0.05 to 10 g per liter of water, the concentration of the chloroprene latex is 0.01 to 4% by weight, the amount of the water glass as aqueous solution permeated into the layer of fibers is 0.5 to 2 liters/dm$^2$, and the amount of the chloroprene latex permeated into the layer of fibers is 2 to 50% by weight as solids based on the asbestos.

2. The method of claim 1 wherein the concentration of the water glass in the aqueous solution is 1 to 5 g per liter of water.

3. The process of claim 1 wherein the concentration of the chloroprene latex is 0.05 to 0.7% by weight.

4. The method of claim 1 wherein the amount of the chloroprene latex permeated into the layer of fibers is 4 to 20% by weight as solids based on the asbestos.

* * * * *